United States Patent [19]

Ito et al.

[11] Patent Number: 4,870,459

[45] Date of Patent: Sep. 26, 1989

[54] COPYING MACHINE

[75] Inventors: Masazumi Ito; Keiji Kusumoto; Yoshiaki Takano; Takashi Noda, all of Osaka, Japan

[73] Assignee: Minolta Camera Kabushiki Kaisha, Osaka, Japan

[21] Appl. No.: 267,435

[22] Filed: Nov. 4, 1988

[30] Foreign Application Priority Data

| | | | |
|---|---|---|---|
| Nov. 6, 1987 | [JP] | Japan | 62-281367 |
| Nov. 6, 1987 | [JP] | Japan | 62-281368 |
| Nov. 6, 1987 | [JP] | Japan | 62-281369 |
| Nov. 6, 1987 | [JP] | Japan | 62-281370 |

[51] Int. Cl.[4] ..... G03G 15/00

[52] U.S. Cl. ..... 355/209; 355/204; 355/206; 355/308

[58] Field of Search ..... 355/209, 203, 204, 206, 355/308

[56] References Cited

U.S. PATENT DOCUMENTS

| | | | |
|---|---|---|---|
| 4,464,044 | 8/1984 | Matsuyama | 355/209 |
| 4,490,035 | 12/1984 | Sugiura | 355/206 X |
| 4,494,861 | 1/1985 | Tachika et al. | 355/308 |
| 4,496,237 | 1/1985 | Schrow | 355/209 |
| 4,530,593 | 7/1985 | Kasuya et al. | 355/206 X |
| 4,553,830 | 11/1985 | Nguyen | 355/209 |
| 4,588,284 | 5/1986 | Federico et al. | 355/308 X |

FOREIGN PATENT DOCUMENTS

| | | |
|---|---|---|
| 85975 | 8/1983 | European Pat. Off. . |
| 54-29643 | 3/1979 | Japan . |
| 57-59548 | 12/1982 | Japan . |
| 58-219570 | 12/1983 | Japan . |
| 58-219571 | 12/1983 | Japan . |
| 59-93466 | 5/1984 | Japan . |
| 60-76765 | 1/1985 | Japan . |
| 61-55662 | 3/1986 | Japan . |
| 61-80170 | 4/1986 | Japan . |
| 61-88279 | 5/1986 | Japan . |
| 62-3261 | 1/1987 | Japan . |

*Primary Examiner*—A. C. Prescott

*Attorney, Agent, or Firm*—Burns, Doane, Swecker & Mathis

[57] ABSTRACT

A copying machine having a premaintenance system for maintaining various parts thereof based upon a value to be set for premaintenance of them which is renewed to that reflecting the number of copies counted from the latest maintenance to the present maintenance at least one time, which comprises a counter for counting the number of copies, a memory for memorizing the value to be set for premaintenance, a key for instructing completion of each maintenance operation and a premaintenance control means for renewing the value of premaintenance based upon the present count value counted by the counter from the latest maintenance to the present one.

17 Claims, 13 Drawing Sheets

COPYING MACHINE

BACKGROUND OF THE INVENTION

1. Field of the Invention

The present invention relates to a copying machine and particularly, to a premaintenance system therefor.

2. Description of the Prior Art

An electrophotographic copying machine widely used as a copying machine is comprised of a variety of parts such as photoconductor drum, developer means, various chargers and the like. In such a copying machine, each part does not necessarily have the duration of life same to those of other parts since use conditions of them are different from each other.

In other words, each part has a proper duration of life due to the condition under which it is used.

In a conventional electrophotographic copying machine, there is provided a premaintenance function for enabling to request maintenance for each of important parts thereof when exchange of it is decided to be necessary. According to this function, when the number of copies has attained to a predetermined number, an instruction such as "MAINTENANCE CALL" is displayed on an operation panel thereof. The user, when he recognized the instruction, calls a service man. If the service man receives the call, he will exchange at least one of parts to new one before it is worn out. This guarantees a long life of the copying machine without any trouble.

Since each part to be premaintained has a proper duration of life as mentioned above, the premaintenance cycle for the maintenance request function, namely the exchange cycle should be determined corresponding to each of parts to be maintained.

However, in a conventional maintenance system, only one exchange cycle is predetermined so as to be the greatest common measure among various duration of lives of individual parts since the maintenance system becomes complicated if respective exchange cycles of parts are to be set independently.

However, it is to be noted that the actual duration of life of each part is greatly affected by the environment in which the copying machine is settled and the manner of use. In other words, the exchange cycle as G. C. M. should be naturally be altered according to use condition under which the copying machine is used.

However, in the conventional copying machine, the exchange cycle is predetermined regardless to the use condition. Further, though it can be altered after the settlement of the machine, it is not so easy to set a suitable exchange cycle in place of the predetermined one.

In another conventional copying machine, a plurality of checking items are provided and individual items are checked separately (See JP-A No. 60-76765).

Further, there has been proposed a copying machine having a plurality of counters for counting the number of copies and numbers of use times of individual parts to be checked.

Furthermore, there has been known a copying machine having counters for counting respective numbers of copies corresponding to respective sizes of copy papers (See JP-B No. 57-59548) or a copying machine having a counter for counting the number of miss copies other than a copy counter of normal copies (See JP-A Nos. 58-219570 or 58-219571).

However, in these copying machines, each of premaintenance cycles is determined beforehand.

SUMMARY OF THE INVENTION

One object of the present invention is to provide a copying machine in which premaintenance for various parts is made in accordance with situation of use of the machine.

Another object of the present invention is to provide a copying machine having plural premaintenance modes among which one premaintenance mode can be selected in accordance with situation of use of the machine.

In order to accomplish these objects, according to one aspect of the present invention, there is provided a copying machine comprising: a count means for counting the number of copies; a memory means for memorizing a value to be set for premaintenance of the copying machine; a maintenance display means for displaying an indication for requesting a maintenance operation when said count means counts up to said set value for premaintenance; a signal means for generating a completion signal indicating completion of the maintenance operation; and a control means for enabling said memory means to memorize the present count value of said count means as said set value for premaintenance and resetting said count means at an initial value in response to said completion signal.

In this copying machine, the set value for premaintenance is renewed to the number of copies counted from the latest maintenance operation to the present one at every maintenance operation as far as the latter number is smaller than the former one.

According to another aspect of the present invention, there is provided a copying machine comprising: a count means for counting the number of copies; a memory means for memorizing a value to be set for premaintenance of the copying machine; a maintenance display mean for displaying an indication for requesting a maintenance operation when said count means counts up to said set value for premaintenance; a signal means for generating a completion signal indicating completion of the maintenance operation; and a control means for enabling said memory means to memorize the present count value as the set value for premaintenance and resetting said count means to the initial value thereof in response to said completion signal indicative of the completion of the first maintenance operation and for resetting said count means to the initial value in response to said completion signal indicative of the completion of the second and thereafter maintenances.

In this copying machine, the set value for premaintenance is altered once from a predetermined initial value to the number of copies counted from the beginning of use to the first maintenance operation.

According to one more aspect of the present invention, there is provided a copying machine comprising: a count means for counting the number of copies; a memory means for memorizing a value to be set for premaintenance of the copying machine; a maintenance display means for displaying an indication for requesting a maintenance operation when said count means counts up to said set value for premaintenance; a signal means for generating a completion signal indicating completion of the maintenance operation; and a control means for enabling said memory means to memorize an average count value VIC/N as the set value for premaintenance in response to said completion signal wherein VIC is the total number of copies from the beginning and N is the total number of times of maintenance operations having been done until the present time.

In this copying machine, the set value for premaintenance is renewed to the average value of the number of copies per one maintenance cycle.

According to a further aspect of the present invention, there is provided a copying machine comprising: a memory means for memorizing a value to be set for premaintenance of the copying machine; first count means for counting the number of copies after the latest maintenance operation; second count means for counting the total number VIC of copies from the beginning to the present time; third count means for counting the number N of times of maintenance operations having been done from the beginning to the present time; a signal means for generating a completion signal upon completion of every maintenance operation; first premaintenance means for setting the present count value of said first count means as said value for premaintenance in response to said completion signal; second premaintenance means for setting the count value counted by said first count means from the beginning to the first maintenance operation as said set value for premaintenance in response to said first completion signal; third premaintenance means for setting an average value VIC/N as said set value for premaintenance in response to said completion signal; and a select means for selecting either one of said first to third premaintenance means.

In this copying machine, the service man can select either one of the first to third premaintenance modes in accordance with use condition of the copying machine.

BRIEF DESCRIPTION OF DRAWINGS

These and other objects and features of the present invention will become more apparent when the preferred embodiment of the present invention is described in detail with reference of accompanied drawings in that.

Figure 7:
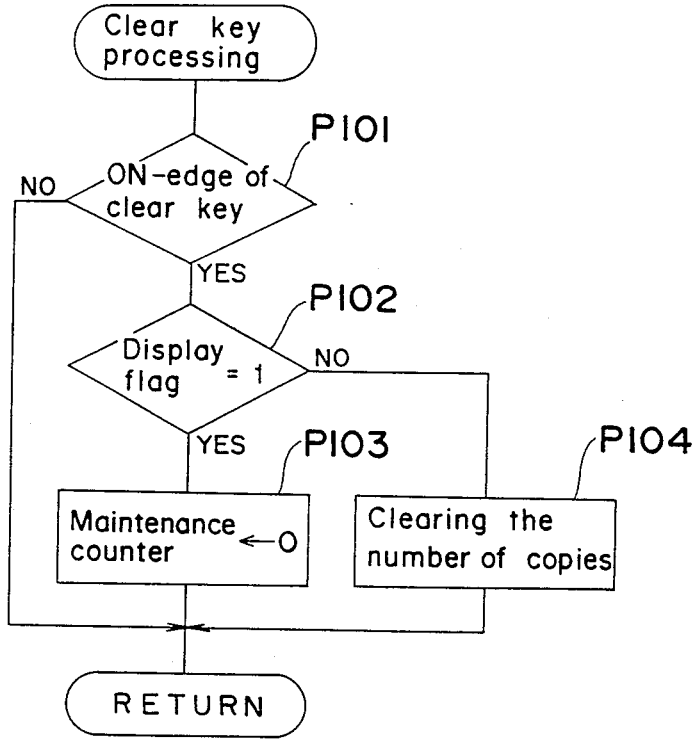
Figure 9:
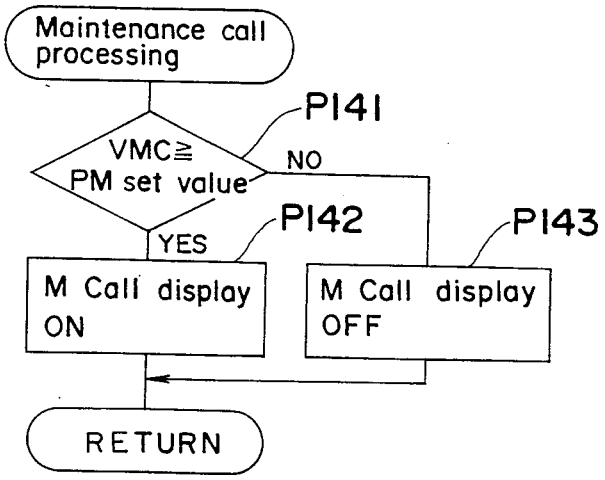
Figure 8:
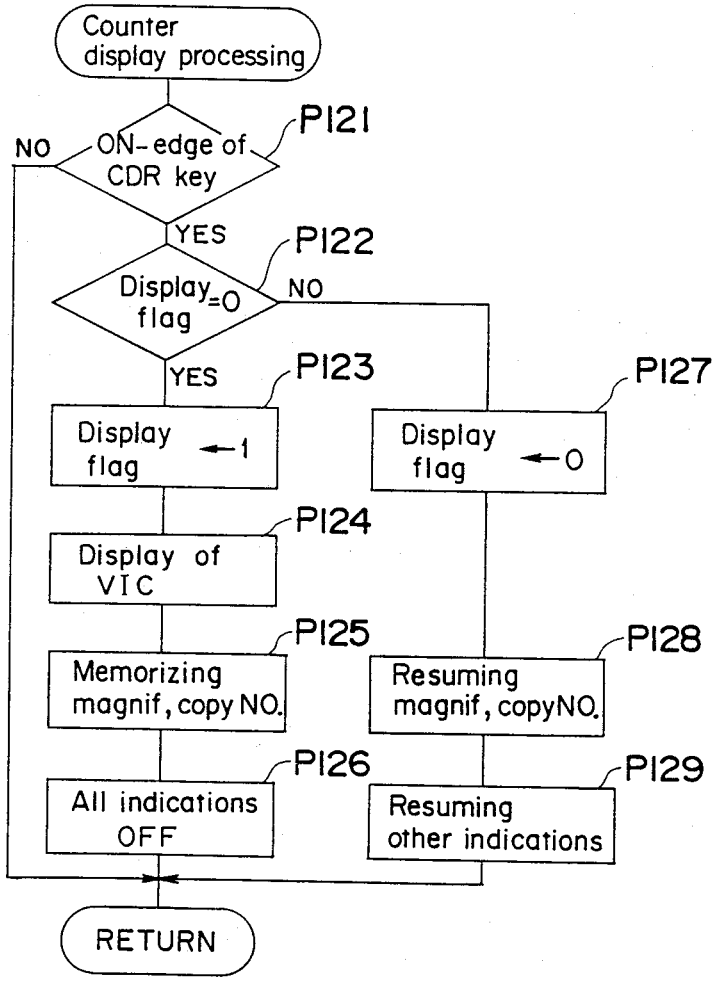
Figure 10A:
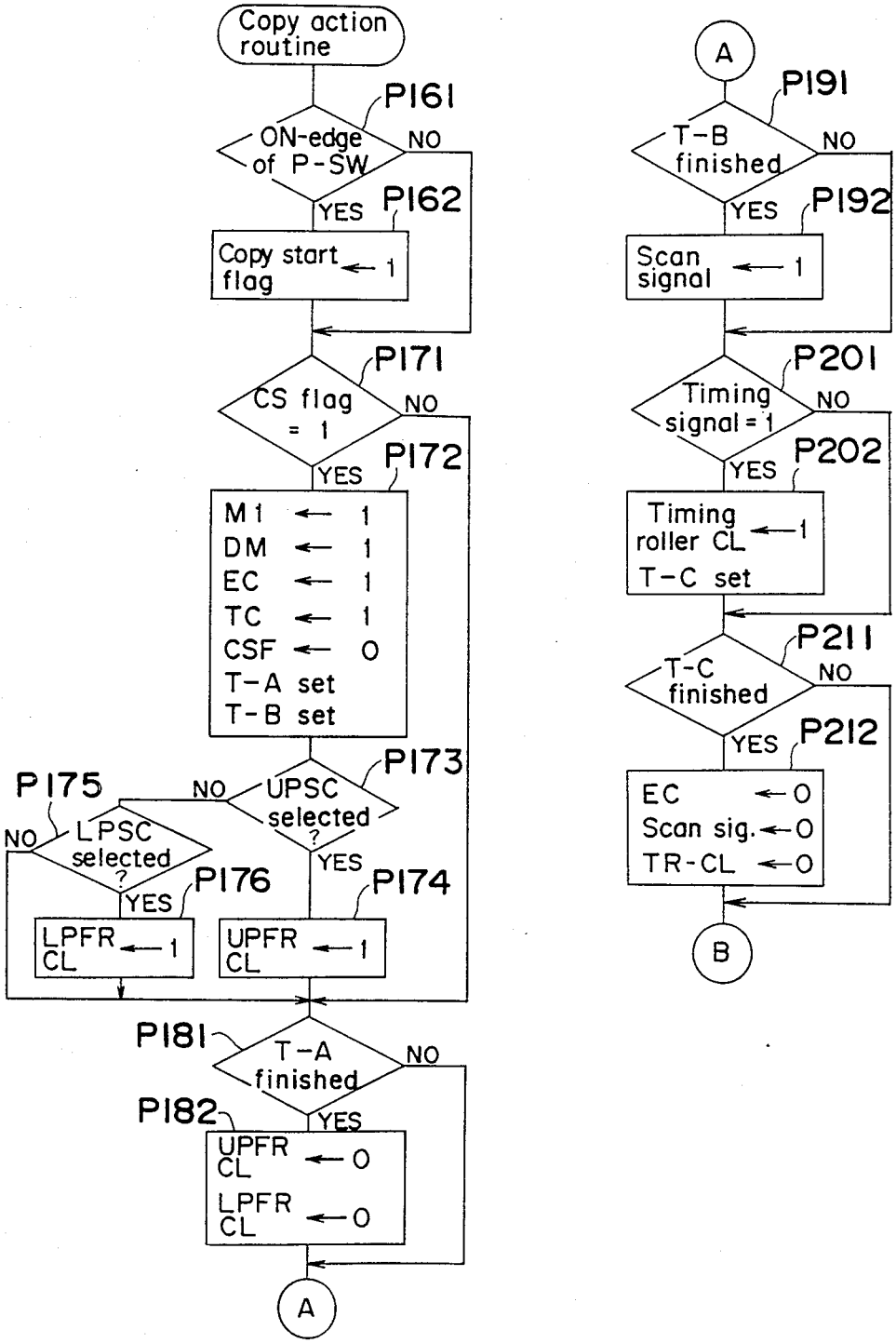
Figure 10:
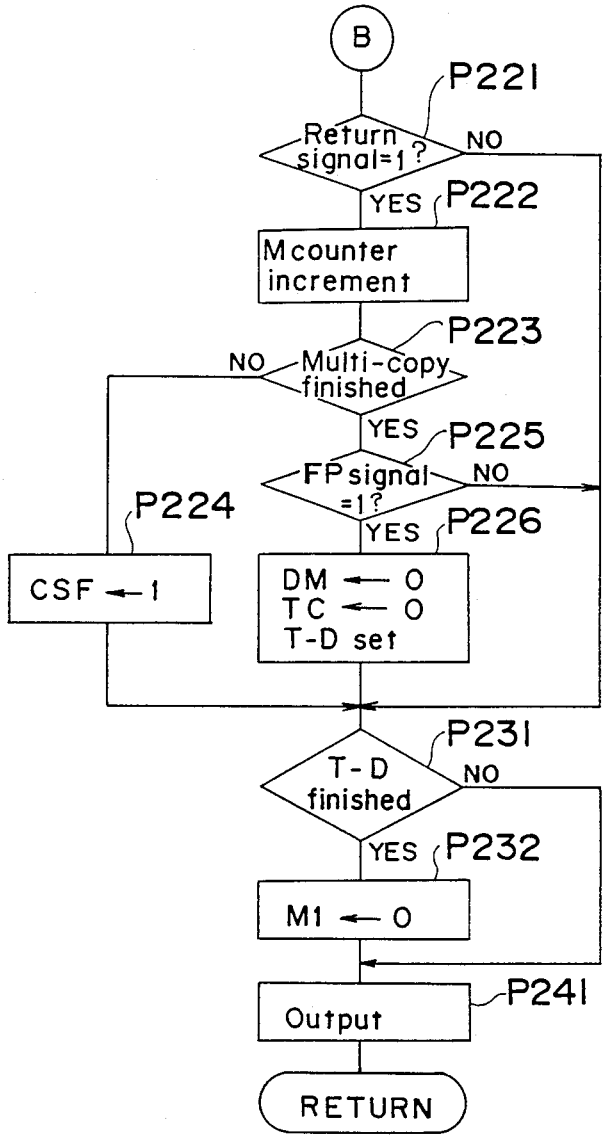

FIGS. (*a*), 6(*b*) and 6(*c*) are series of a flow chart of the subroutine for maintenance completion key processing according to the present invention;

FIG. 7 is a flow chart of the subroutine for clear key processing;

FIG. 8 is a flow chart of the subroutine for counter display processing;

FIG. 9 is a flow chart of the subroutine for maintenance call display processing; and FIGS. 10(*a*) and 10(*b*) are series of a flow chart of the subroutine for copying action.

DETAILED DESCRIPTION OF THE PREFERRED EMBODIMENT

(a) Composition of copying machine

Figure 1:
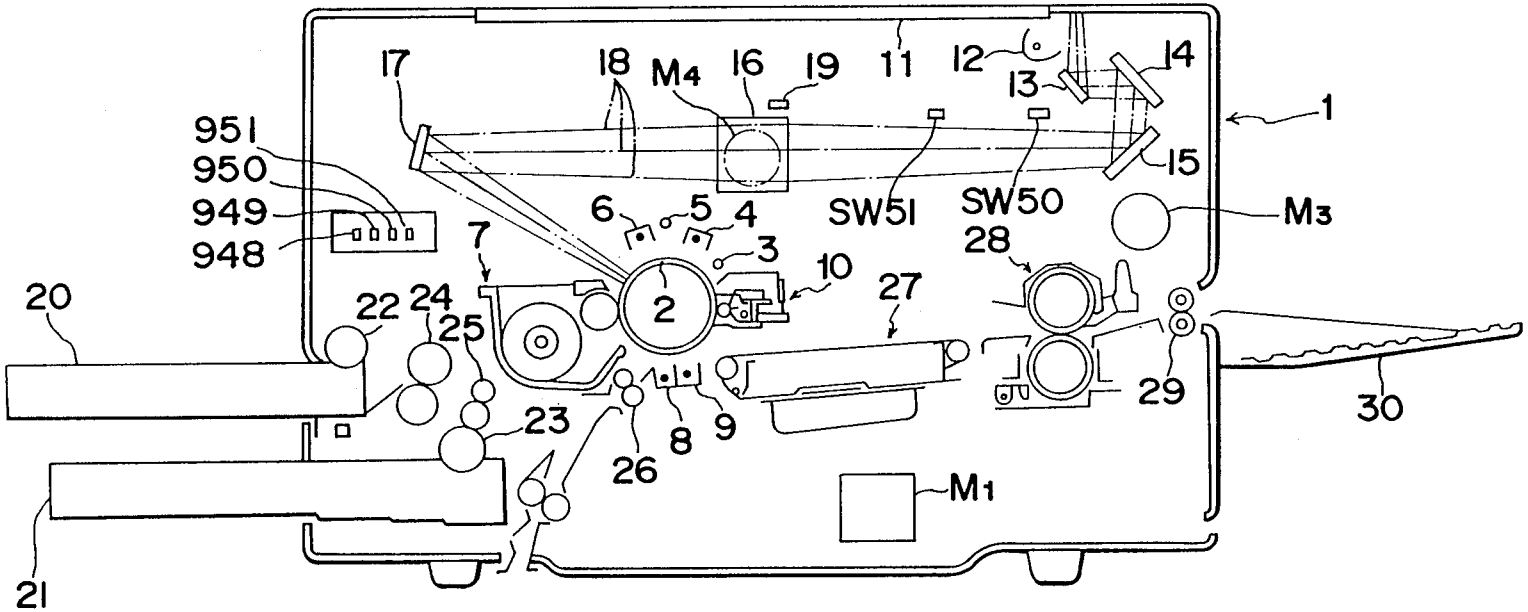
FIG. 1 is a schematic sectional view of an electrophotographic copying machine to which the present invention is applied.

FIG. 1 is a schematic cross-sectional view of an electrophotographic copying machine to which the present invention is applied.

Structures of the copying machine 1 are substantially same to those of a conventional electrophotographic copying machine.

In the central portion of the main body of the copying machine 1, a photoconductor drum 2 is arranged rotatably about the axis thereof.

Around the photoconductor drum 2, a main eraser lamp 3, a sub-electrifying charger 4, a sub-eraser lamp 5, a main electrifying charge 6, a developing device 7, a transferring charger 8, a charger 9 for separating a transferred paper and a cleaner 10 of blade type are arranged successively in an anti-clockwise direction in FIG. 1.

The photoconductor drum 2 has a photoconductive layer on the surface thereof and, during a copy process, is irradiated by the eraser lamps 3 and 5, is electrified by the electrifying chargers 4 and 6 and, then, is exposed to an image of a document through an optical scanning system which will be explained later.

A motor M1 is provided for driving the photoconductor drum 2 via a driving mechanism (not shown).

The optical scanning system is arranged beneath a glass platen 11 so as to be able to scan an image of a document set on the glass platen 11. This optical system is comprised of a light source 12, first to third mirrors 13 to 15, a projecting lens 16 and fourth mirror 17. The scanned image of the document is projected onto the photoconductor drum 2 via the first to fourth mirrors 13, 14, 15 and 17 as indicated by imaginary lines 18 in FIG. 1. A standard position switch SW 50 is provided for detecting that the optical scanning system locates at a predetermined position (standard position) upon starting the scanning.

The magnification for copying a document is varied by moving the projecting lens 16 in a direction of the optical axis thereof with use of a motor M4.

Further, a motor M3 (not shown in FIG. 1 ) is provided for driving the optical scanning system. If the copy magnification is set at "n" and the peripheral rotational velocity of the drum 2 is set at "v" regardless to the magnification n, the light source 12 and the first mirror 13 is moved by the motor M3 at a velocity (v/n) and the second and third mirrors 14 and 15 are moved at a velocity (v/2n) in the same direction. The image is projected onto the photoconductor drum 2, via the fourth mirror 17 as slit images according to the movement of the optical scanning system.

At the lefthand side of the main body of the copying machine 1, a first paper feeding cassette 20 is detachably arranged corresponding to an upper paper feeding aperture and the second paper feeding cassette 21 is arranged detachably corresponding to a lower paper feeding aperture. Each of copy papers contained in the first or second paper feeding cassette 20 or 21 is fed selectively by a paper feeding roller 22 or 23 and is conveyed to a pair of timing rollers 26 via a pair of conveying rollers 24 and/or a pair of conveying rollers 25 to wait for a paper feed timing.

Upon transferring, the copy paper fed by the pair of timing rollers 26 is contacted to the surface of the photoconductor drum 2 and a toner image formed on the drum 2 is transferred to the copy paper by corona discharge of the transferring charger 8. Thereafter, the copy paper is separated from the drum 2 by corona discharge of the separating charger 9 and the stiffness of the copy paper. Then, the separated copy paper is conveyed by a conveyer belt 27 having an air suction means (not shown) toward a fixing apparatus 28. The toner image on the copy paper is fixed by the fixing apparatus 28 and discharged, via a pair of discharging roller 29, onto a discharge tray 30 or a sorter (not shown).

As shown in FIG. 1, in the lefthand side portion of the main body of the machine 1, an initializing key 948 and a maintenance completion key 949 are provided for premaintenance of parts. Also, two select keys 950 and 951 are provided for selecting one of maintenance modes.

(b) Operation panel

Figure 2A:
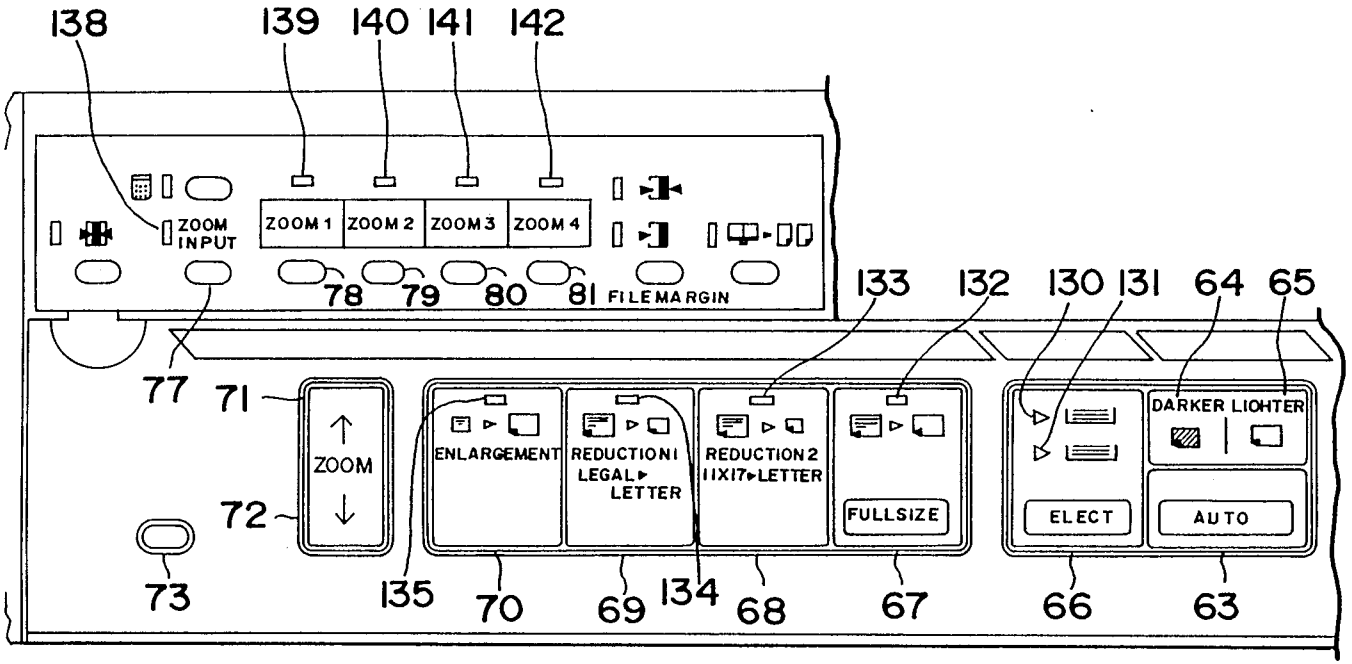
FIGS. 2(*a*) and 2(*b*) are plan views of portions of an operation panel of the copying machine.
Figure 2B:
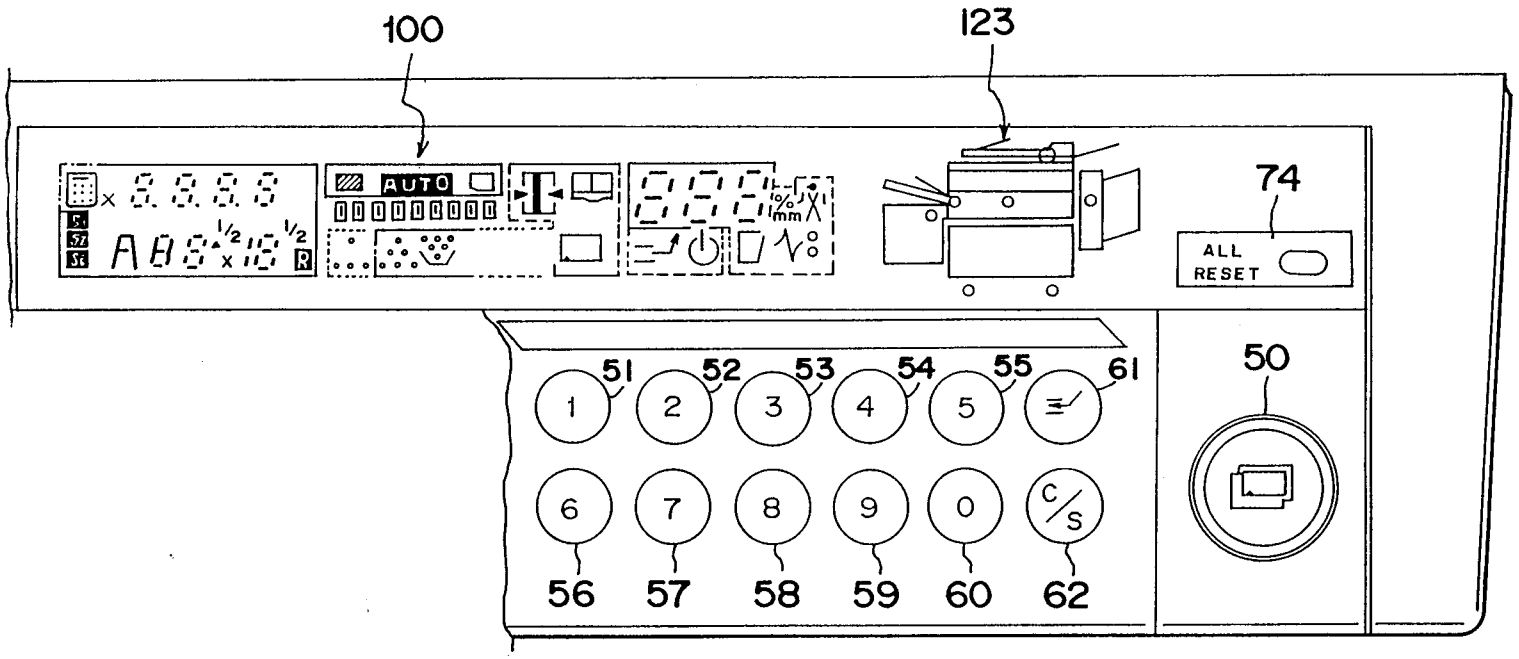

FIGS. 2(*a*) and 2(*b*) show an operation panel of the copying machine.

The following keys are arranged on the operation panel.

50: print button for starting a copy operation;
51 to 60: ten keys for setting a number such as the number of copies;
61: interruption key for performing an interruption copy;
62: stop & clear key for stopping a multi-copy and clearing a set number;
63: select/cancel key for selecting and cancelling the automatic exposure mode;
64: down key for decreasing the amount of exposure in the case of manual exposure;
65: up key for increasing the amount of exposure in the case of manual exposure;
66: select key for selecting a desirable paper feeding aperture (cassette);
67 to 70: copy magnification select key for selecting a fixed magnification among the equal magnification, two reduction magnifications and one enlargement magnification;
71: magnification up key for increasing the magnification stepwise;
72: magnification down key for decreasing the magnification stepwise;
73: request key for requesting to display the present count value;
74: all reset key for initializing the copy mode into the initial mode;
78 to 81: zoom magnification select key for selecting one of zoom magnifications having been set beforehand.

The portion of the operation panel indicated by reference numeral 100 is a display for displaying various information with use of fluorescent character display tubes.

Figure 3:
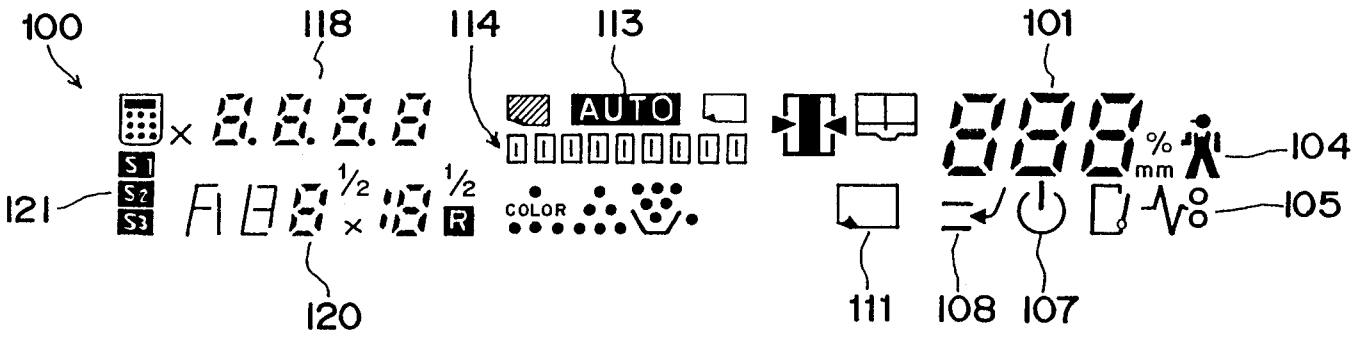
FIG. 3 is an enlarged plan view of the portion indicated by a reference numeral 100 in FIG. 2(*b*)

FIG. 3 shows contents of the information together with reference numerals.

101: display segment of three figures for displaying a number such as the number of copies;
104: pictorial symbol for indicating to call a service man (maintenance call indicating);
105: pictorial symbol for indicating a jamming (jam call indication);
108: indication for indicating an interruption copy ("in interruption copy" indication);
111: paper empty indication;
113: indication for indicating the designated exposure mode (automatic or manual exposure)
114: indication for indicating the amount of exposure stepwise;
118: indication for indicating the copy magnification;
120: indication for the paper size;
121: indication for indicating the kind of copy paper;

Returning to FIGS. 2(*a*) and 2(*b*), various LED indicators are arranged on the operation panel.

123: monitor indicator;
130: LED indicator for showing selection of the upper paper feeding aperture;
131: LED indicator for showing selection of the lower one;
132 to 135: LED indicators for showing a selected magnification among the fixed magnifications to be set by the keys from 67 to 70;
138: LED indicator for indicating the selection of the mode for entering desirable zoom magnifications;
139 to 142: LED indicators for showing a selected zoom magnification among four zoom magnifications.

(c) Composition of controller

Figure 4:
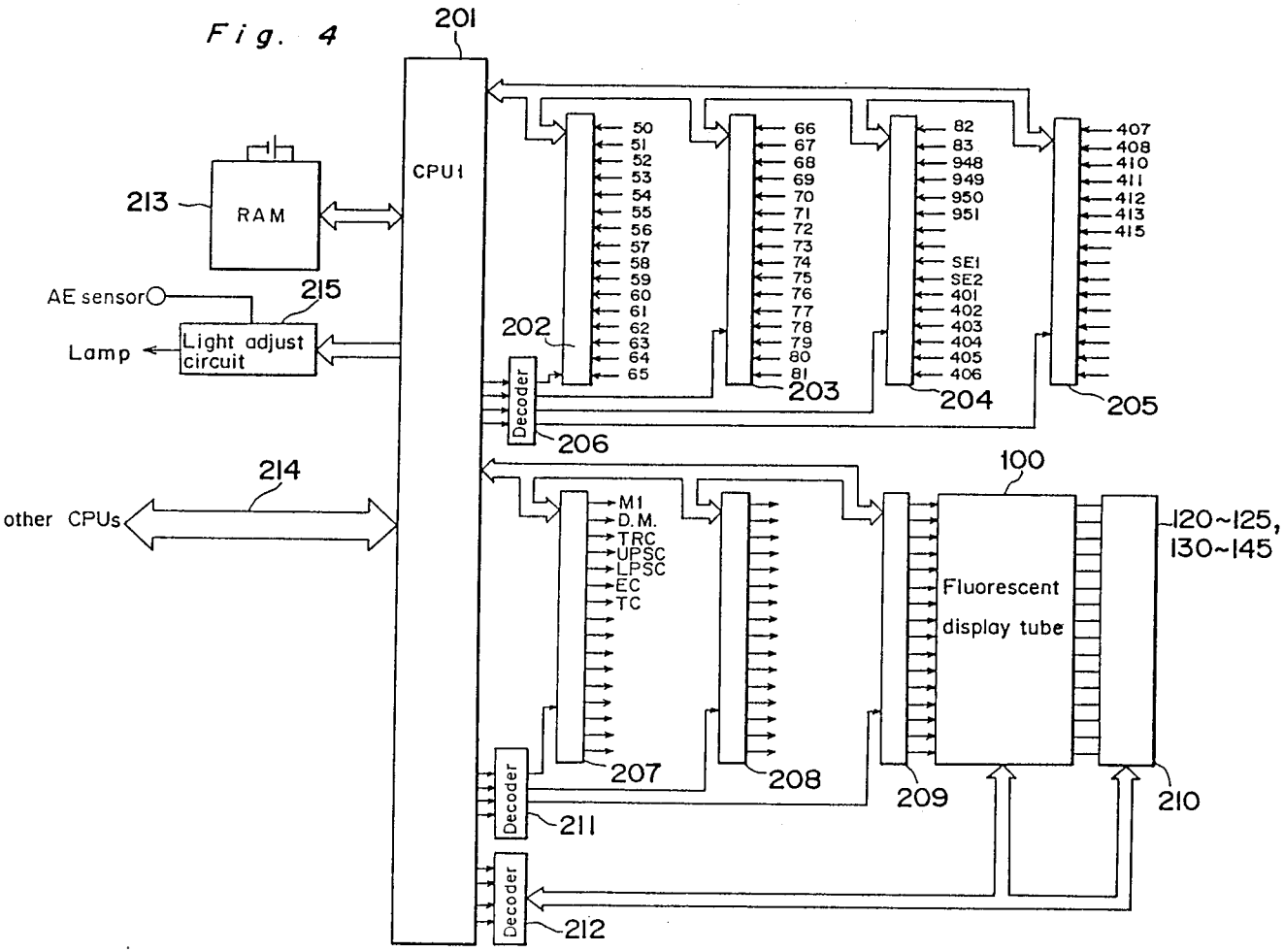
FIG. 4 is a block diagram of a control circuit of the copying machine by which the present invention is executed.

FIG. 4 shows a system composition of the controller having a microcomputer (CPU 1) 201 for controlling the copying machine. ICs 202 to 205 and 207 to 209 are provided as input/output expansion units. ICs 202 to 205 are used for input expansion units and connected to the microcomputer 201 through data line. These are controlled, via a decoder 206, by the microcomputer 201. Various keys and indicators are connected to input terminals of each IC, as shown in FIG. 4.

ICs 207 to 209 are used for output expansion units and individual control ports of them are connected to the microcomputer 201 via a decoder 211. Individual output terminals of each of IC units 207 and 208 are connected to various parts of the copying machine such as the main motor M1, developing motor, chargers, erasers and the like to drive them and output terminals of the IC unit 209 are connected to the fluorescent display tube 100 and an LED matrix comprised of LED indicators of 120 to 125 and 130 to 145. The fluorescent display tube 100 and LED matrix 210 are controlled, via a decoder 212, by the CPU 1.

RAM (random access memory) 213 is also connected to the CPU 1 and backed up by battery means. A bus 214 communicates the CPU 1 with other microcomputers provided for controlling other parts such as the optical scanning system. The CPU 1 transmits a selected value of nine exposure values in the case of manual exposure mode or a center value in the case of automatic exposure mode to a light adjusting circuit 215.

(d) Flows for controlling the machine

Before starting explanation of flow charts shown in FIGS. 5 to 10, terms of "on-edge" and "off-edge" are defined as follows;

The term "on-edge" indicates change in the state of a switch, a sensor, a signal or the like when changed from off-state to on-state. Also, the term "off-edge"indicates change in the state of a switch, a sensor, a signal or the like when changed from on-state to off-state.

Figure 5:
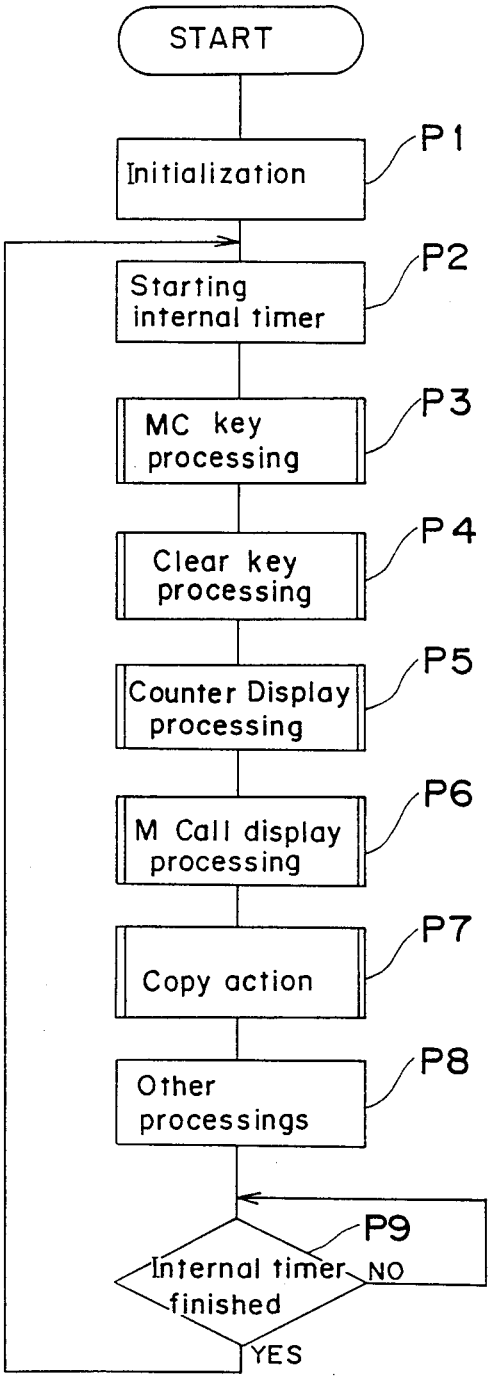
FIG. 5 is a flow chart of the main routine to be executed by CPU 1.

FIG. 5 shows a main flow chart to be executed by the CPU 1.

When the main program is started by resetting the CPU 1, initialization of the CPU 1 including clearing of the RAM 213, setting of various registers and the like and initial setting of various devices in the copying machine are performed at step P1.

Thereafter, an internal timer is started at step P2 which is defined in the CPU 1 so as to have a predetermined initial value.

Then subroutines from step P3 to step P8 are called successively. If all of the subroutines have been executed, one routine is completed when the internal timer is finished at step P9. Various timers defined in the above mentioned subroutines count their own times with use of the time interval of one routine measured by the internal timer. Namely, each timer counts its own count in unit of the time interval of one routine.

Figure 6A:
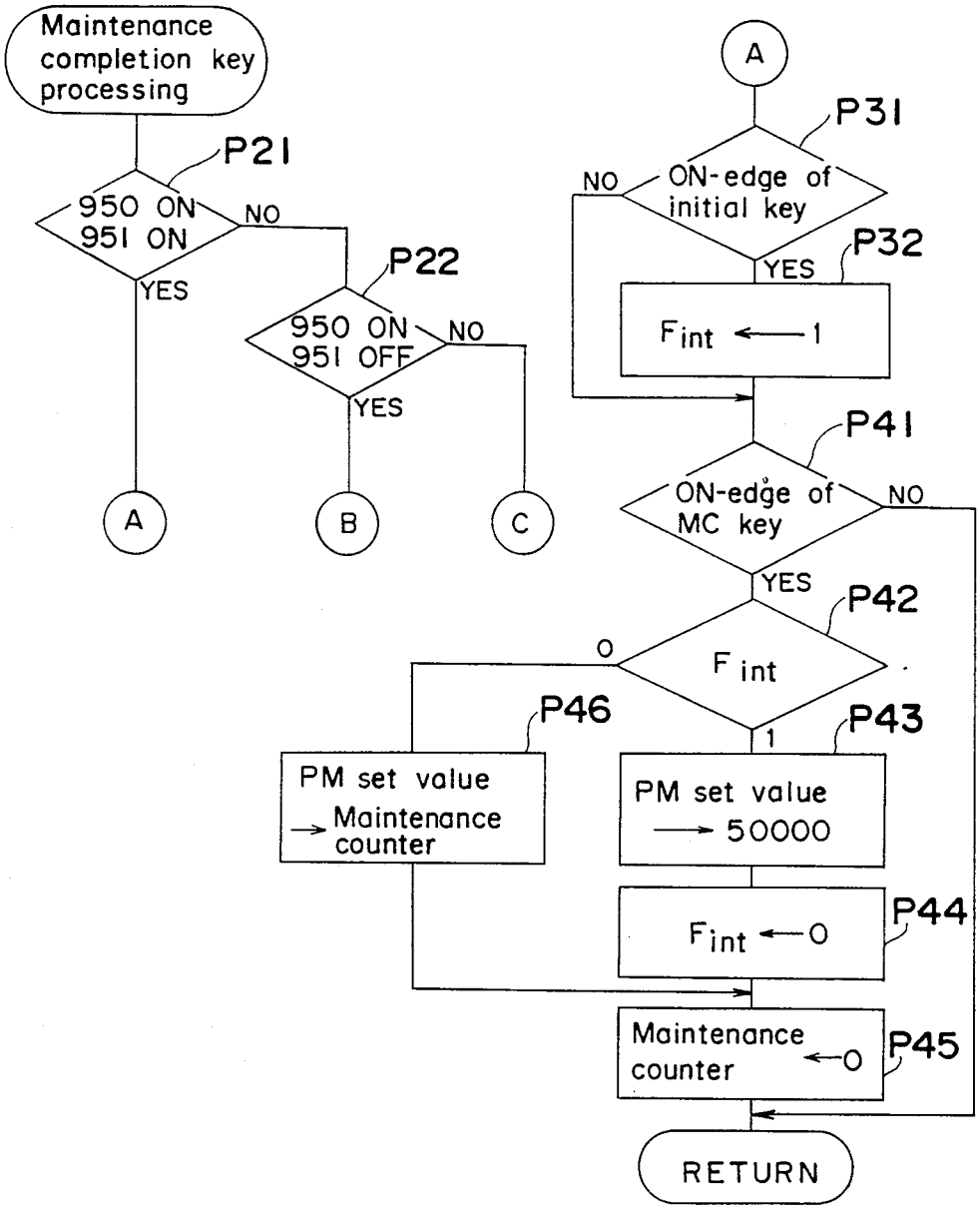
Figure 6B:
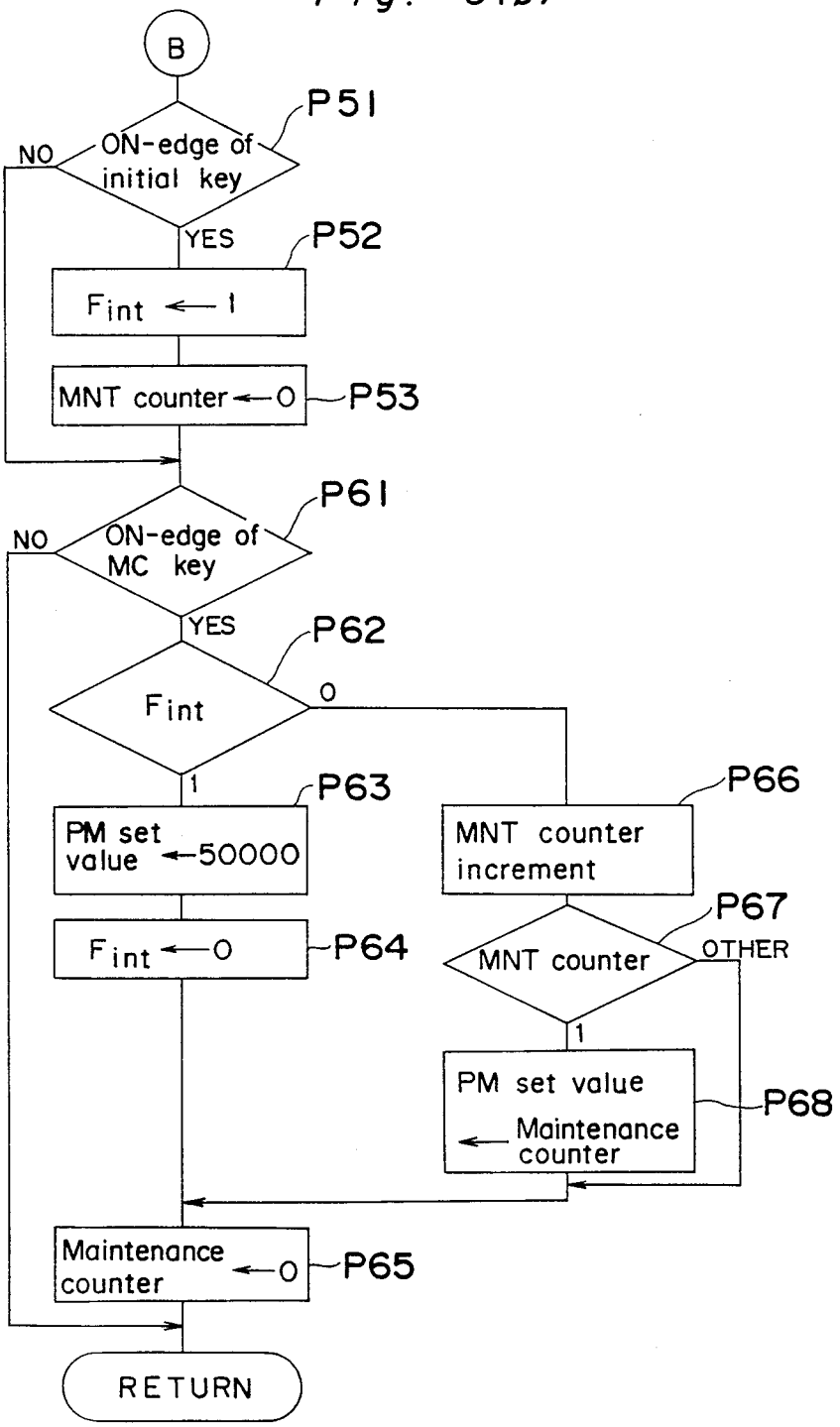
Figure 6C:
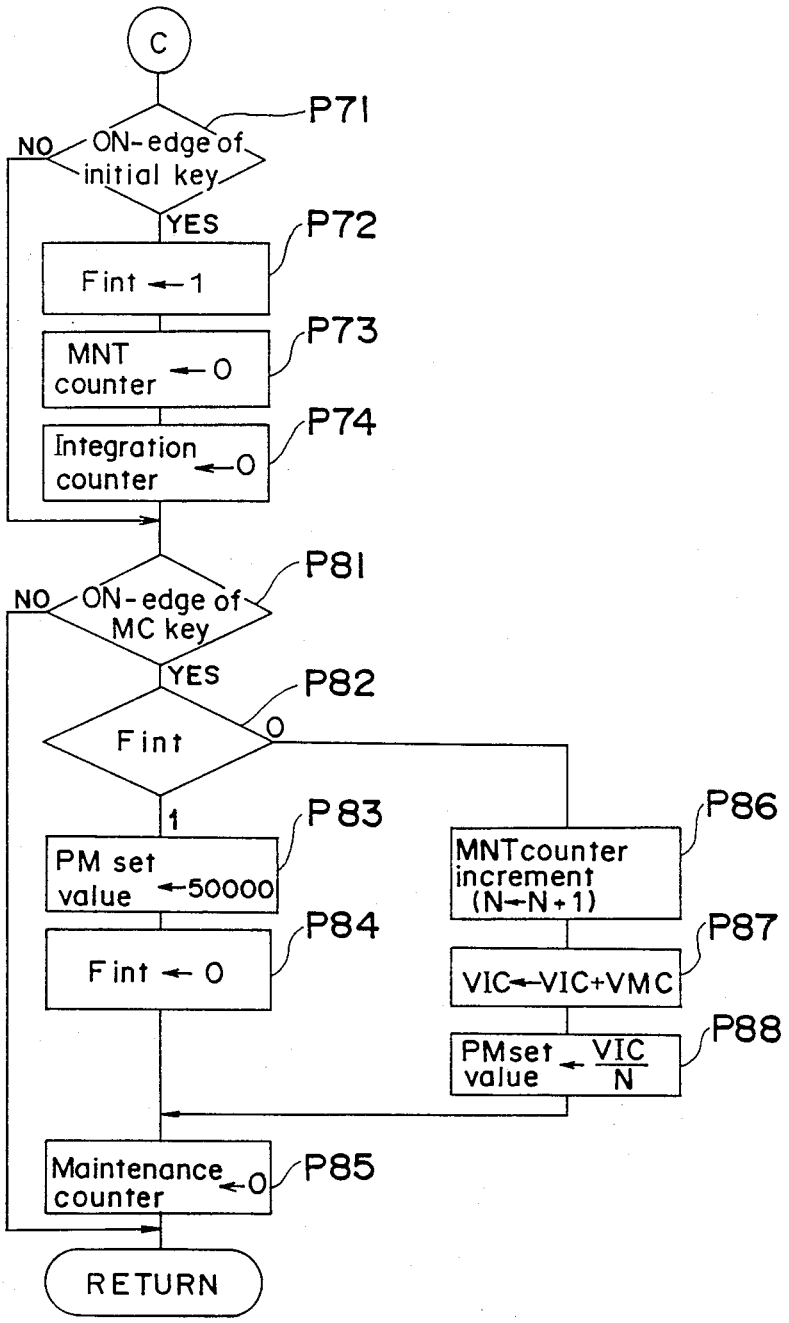

FIGS. 6(*a*), 6(*b*) and 6(*c*) shows a flow chart of the subroutine (P3) for maintenance completion key processing.

In this subroutine, set states of maintenance method select keys 950 and 951 are checked at steps P21 and P22, respectively (See FIG. 1). These two keys 950 and 951 are provided for selecting either one of three maintenance methods as will be explained later. In other words, a service man can designate a desirable maintenance method by operating these two keys 950 and 951.

If it is decided at step P21 that both of two keys 950 and 951 are in ON-state, the processing according to the first maintenance method is executed from step P31 to step P46.

When the ON-edge of the initial key 948 is detected at step P31, a flag $F_{int}$ indicating the ON-edge of the initial key is set to "1" at step P32. Next, when the ON-edge of the maintenance completion key 949 is detected at step P41, the value of the flag $F_{int}$ is checked at step P42. If it is set at "1", the set value of a premaintenance counter is set at "50,000" at step P43 and, thereafter, the flag $F_{int}$ is reset at "0" at step P43. This initial set value is predetermined so as to be much more larger than the number of copies at which a maintenance operation will be needed usually.

If the value of the flag $F_{int}$ is set at "0" at step P42, the present value of the maintenance counter is set as the set value of the premaintenance counter at step P46. Thereafter, the maintenance counter is reset to "0" at step P45. The premaintenance counter is defined as a counter which is incremented every completion of one copy operation.

As is apparent from the above, according to the first maintenance method shown from step P31 to step P45 of FIG. 6(*a*), the initial set value of the premaintenance counter is set to "50,000" by switching on both of the initial key 948 and the maintenance completion key 949 upon settlement of the copying machine. If the service man is called for maintenance before the maintenance counter counts up to "50,000", the next set value of the premaintenance counter is set at the present value of the maintenance counter which is smaller than "50,000" and the latter counter is reset to "0" by operating the maintenance completion key 949 after completion of the first time maintenance. Thus, the set value of the premaintenance counter is renewed to an actual count value of the maintenance counter counted between the last maintenance and the maintenance of this time.

However, if the service man is not called until the maintenance counter counts up to the set value of the premaintenance counter, the next set value of the latter is set at the last set value again.

As will be explained later with use of FIG. 9, the pictorial symbol 104 for "SERVICE MAN CALL" is usually turned on in order to enable the user to call the service man when the maintenance counter counts up to the set value of the premaintenance counter.

On the contrary to the above, if the select key 950 is switched on but the select key 951 is not operated upon settlement of the copying machine, the second maintenance method is selected and the process goes to step P51 of FIG. 6(*b*).

When the on-edge of the initial key 948 is detected at step P51, the flag $F_{int}$ is set at "1" at step P52 and a maintenance number of times counter is reset to "0" at step P53.

Then, the service man operates the maintenance completion key. If the on-edge thereof is detected at step P61, the flag $F_{int}$ is checked at step P62. Since it is set at "1" for the first time, the process goes to step P63 to set the initial set value of the premaintenance counter at "50,000" and, then, the flag $F_{int}$ is reset to "0" at step P64. Next, the maintenance counter is reset at "0" at step P65.

If the service man is called for maintenance before or when the maintenance counter counts up to "50,000", the process goes to step P66 when the on-edge of the maintenance completion key is detected at step P61, namely, he operates the key after completion of the maintenance.

At step P66, the maintenance number of times counter is incremented by one and the count value thereof is checked at step P67. Since it is "1" in the case of the first maintenance, the process goes to step P68 to set the next set value of the premaintenance counter to the present count value of the maintenance counter. Namely, if the service man is called for maintenance for the first time after settlement of the copying machine and before the maintenance counter counts up to the initial set value "50,000", the premaintenance counter is set at the present count value of the maintenance counter. In other words, if so, the next set value of the premaintenance counter is set at a value smaller than "50,000".

If the count value of the maintenance number of times counter becomes larger than "1", namely after the maintenance of the second time, the set value of the premaintenance counter is kept unchanged since the process skips from step P67 to step P65 without executing step P68.

If the service man operates the initial key 948 without operating both of two select keys 950 and 951 after settlement of the copying machine, the third maintenance method is selected contents of which are shown in FIG. 6(*c*).

When the on-edge of the initial key 948 is detected at step P71, the flag $F_{int}$ is set to "1" at step P72. Then the maintenance number of times counter is reset to "0" at step P73 and an integration counter provided for integrating each count value by the maintenance counter is also reset to "0" at step P74.

After operating the initial key 948, the service man operates the maintenance completion key 949 in order to set the premaintenance counter to the initial set value.

When the on-edge of the maintenance completion key 948 is detected at step P81, the process goes to step P82 in order to check the flag $F_{int}$.

Since the flag $F_{int}$ is set at step P72, the process advances to step P83 and the initial set value of the premaintenance counter is set to "50,000". Then the flag $F_{int}$ is reset to "0" at step P84 and the maintenance counter is reset at step P85.

If the maintenance is requested for the first time, the service man performs the first maintenance and, thereafter, operates the maintenance completion key.

Since the flag $F_{int}$ has been reset at this stage, the process advances from step P82 to step P86. At step P86, the maintenance number of times counter is incremented (N←N+1) and, at step P87, the count value VIC of the integration counter is renewed to the sum of the present count value VMC of the maintenance counter and that of the integration counter to obtain the total number of copies from the beginning (VIC←VIC+VMC).

Thereafter, the renewed count value of the integration counter is divided by the maintenance number of times to obtain an average value (VIC/N) and the set value of the premaintenance counter is set to the obtained average at step P88. Namely, an average number of copies per one maintenance is set as the set value of the premaintenance counter.

It is to be noted that each of count values of the above mentioned counters is always maintained because it is memorized in the RAM 213 which is backed up by the battery.

As is apparent from the above, the service man can select either one of the first to third premaintenance methods in accordance with conditions under which the copying machine is used.

FIG. 7 shows a flow chart of the subroutine P4 for clear key processing.

When the on-edge of the clear key 62 is detected at step P101, a display flag is checked at P102. If the display flag is not set at "1", the process goes to step P104 in order to clear the number of copies having been set. However, if it is set at "1" at step P102 and, therefore, if the count value of the maintenance counter displayed, the maintenance counter is reset to "0" at step P103.

FIG. 8 shows a flow chart of the subroutine P5 for counter display processing.

When the on-edge of the counter display request key 73 is detected at step P121, the display flag is checked at step P122. If it is set at "0", namely the magnification or the number of copies is displayed on the display area 118 (See FIG. 3), it is set at "1" at step P123 and the count value of the maintenance counter is displayed at step P124. At that time, the copy magnification and the number of copies are stored in the RAM 213 at step P125 and all other LED indicators are turned off at step P126.

If the count display request key 73 is operated during the display of the value of the maintenance counter, the process goes from step P122 to step P127 and the display flag is reset to "0". Then, the stored magnification and number of copies are resumed to display at step P128. Further, other indications are resumed at step P129.

FIG. 9 shows a flow chart of the subroutine P4 for maintenance call display processing.

When the maintenance counter counts up to the set value of the premaintenance counter at step P141, the pictorial symbol 104 for "SERVICE MAN CALL" is lighted at step P142. The user calls the service man according to the indication thereby.

However, it is to be noted that the maintenance may be performed before the maintenance counter counts up to the set value of the premaintenance counter, namely the pictorial symbol for "SERVICE MAN CALL " is lighted, if the service man considers that at least one of parts should be exchanged with new one upon inspection of the copying machine.

FIGS. 10(*a*) and 10(*b*) show a flow chart of the subroutine P7 for copying action.

When the print key 50 is pushed down and the on-edge thereof is detected at step P161, a copy start flag is set at "1" at step P162.

If the copy start flag is "1" at step P171, the main motor M1 and the developing motor are driven and the electrifying and transfer chargers are energized at step P172. At the same time, the copy start flag is reset to "0"and two timers T-A and T-B are started.

If the first (upper) paper supply cassette 20 is selected at step P173, the clutch for the first paper feeding roller 22 is switched on at step P174.

If the second (lower) paper supply cassette 21 is selected at step P175, the clutch for the paper feeding roller 23 is switched on at step P176.

When the finish timing of the timer T-A is detected at step P181, both clutches are switched off at step P182.

At step P191, the timer T-B is checked and, when the finish timing thereof is detected, a scanning signal is set at "1" at step P192.

If a timing signal is decided to be "1" at step P201, the clutch for the timing roller 26 is switched on and a timer T-C is started at step P202. When the finish timing of the timer T-C is detected at step P211, signals for electrifying and scanning are reset to "0", respectively and, also, the timing roller clutch is switched off at step P212.

When a return signal for returning the optical scanning system is set at "1" at step P221, the maintenance counter is incremented by one at step P222. Then, it is checked whether or not a multiple copying has been finished at step P223, and, if not finished, the process goes to step P224 to set the copy start flag at "1" again.

If the multiple copying has been finished, the waits for a signal from the fixed position switch at step P225. When it is set to "1", the process advances to step P226 to stop the developing motor and the transfer charger and to set the timer T-D.

When the finish timing of the timer T-D is detected at step P231, the main motor M1 is switched off at step P232. Then, results obtained by these processings are outputted at step P241.

The preferred embodiments described herein are illustrative and not restrictive, the scope of the invention being indicated by the appended claims and all variations which come within the meanings of the claims are intended to be embraced herein.

What is claimed is:

1. A copying machine comprising:

a count means for counting the number of copies;

a memory means for memorizing a value to be set for premaintenance of the copying machine;

a maintenance display means for displaying an indication for requesting a maintenance operation when said count means counts up to said set value for premaintenance;

a signal means for generating a completion signal indicting completion of the maintenance operation; and a control means for enabling said memory means to memorize the present count value of said count means as said set value for premaintenance and resetting said count means at an initial value in response to said completion signal.

2. Copying machine as claimed in claim 1, further comprising a set means for setting an initial mode of said copying machine whereby a predetermined value is memorized as said set value for premaintenance into said memory means in response to said completion signal in said initial mode.

3. Copying machine as claimed in claim 2, further comprising:

a numerical display means for displaying at least one numeral in either of plural display modes;

a selection means for selecting a display mode among said plural display modes;

a display control means for controlling said numerical display means in such a manner that the number of copies to be copied is displayed when the first display mode is selected by said selection means and, when the second display mode is selected, the present count value of said count means is displayed.

4. Copying machine as claimed in claim 3, further comprising:

a manually operable reset key for commanding reset of the numeral displayed on said numerical display means whereby the number of copies to be copied is set at zero in response to the command from said reset key in the case that the first display mode is selected and the count value of said count means is reset at the initial value in response to the command from said reset key in the case that the second display mode is selected.

5. Copying machine as claimed in claim 4 in which said signal means includes a manually operable key for indicating completion of a maintenance operation and said set means includes a manually operable initial key.

6. A copying machine comprising:

a count means for counting the number of copies;

a memory means for memorizing a value to be set for premaintenance of the copying machine;

a maintenance display means for displaying an indication for requesting a maintenance operation when said count means counts up to said set value for premaintenance;

a signal means for generating a completion signal indicating completion of the maintenance operation; and a control means for enabling said memory means to memorize the present count value as the set value for premaintenance and resetting said count means to the initial value thereof in response to said completion signal indicative of the completion of the first maintenance operation and for resetting said count means to the initial value in response to said completion signal indicative of the completion of the second and thereafter maintenances.

7. Copying machine as claimed in claim 6, further comprising a set means for setting an initial mode of said copying machine whereby a predetermined value is memorized as said set value for premaintenance into said memory means in response to said completion signal in said initial mode.

8. Copying machine as claimed in claim 7, further comprising:

a numerical display means for displaying at least one numeral in either of plural display modes;

a selection means for selecting a display mode among said plural display modes;

a display control means for controlling said numerical display means in such a manner that the number of copies to be copied is displayed when the first display mode is selected by said selection means and, when the second display mode is selected, the present count value of said count means is displayed.

9. Copying machine as claimed in claim 8, further comprising:

a manually operable reset key for commanding reset of the numeral displayed on said numerical display means whereby the number of copies to be copied is set at zero in response to the command from said reset key in the case that the first display mode is selected and the count value of said count means is reset at the initial value in response to the command from said reset key in the case that the second display mode is selected.

10. Copying machine as claimed in claim 9, in which said signal means includes a manually operable key for indicating completion of a maintenance operation and said set means includes a manually operable initial key.

11. A copying machine comprising:

a count means for counting the number of copies;

a memory means for memorizing a value to be set for premaintenance of the copying machine;

a maintenance display means for displaying an indication for requesting a maintenance operation when said count means counts up to said set value for premaintenance;

a signal means for generating a completion signal indicating completion of the maintenance operation; and a control means for enabling said memory means to memorize an average count value VIC/N as the set value for premaintenance in response to said completion signal wherein VIC is the total number of copies from the beginning and N is the total number of times of maintenance operations having been done until the present time.

12. A copying machine comprising:

a memory means for memorizing a value to be set for premaintenance of the copying machine;

first count means for counting the number of copies after the latest maintenance operation;

second count means for counting the total number VIC of copies from the beginning to the present time;

third count means for counting the number N of times of maintenance operations having been done from the beginning to the present time;

a signal means for generating a completion signal upon completion of every maintenance operation;

first premaintenance means for setting the present count value of said first count means as said value for premaintenance in response to said completion signal;

second premaintenance means for setting the count value counted by said first count means from the beginning to the first maintenance operation as said set value for premaintenance in response to said first completion signal;

third premaintenance means for setting an average value VIC/N as said set value for premaintenance in response to said completion signal; and a select means for selecting either one of said first to third premaintenance means.

13. Copying machine as claimed in claim 12, further comprising an initializing means for setting an initial mode of said copying machine whereby a predetermined value is set as said set value for premaintenance in response to said completion signal in said initial mode.

14. Copying machine as claimed in claim 13, further comprising:

a numerical display means for displaying at least one numeral in either of plural display modes;

a selection means for selecting a display mode among said plural display modes;

a display control means for controlling said numerical display means in such a manner that the number of copies to be copied is displayed when the first display mode is selected by said selection means and, when the second display mode is selected, the present count value of said count means is displayed.

15. Copying machine as claimed in claim 14, further comprising:

a manually operable reset key for commanding reset of the numeral displayed on said numerical display means whereby the number of copies to be copied is set at zero in response to the command from said reset key in the case that the first display mode is selected and the count value of said count means is reset at the initial value in response to the command from said reset key in the case that the second display mode is selected.

16. Copying machine as claimed in claim 15 in which said signal means includes a manually operable key for indicating completion of a maintenance operation and said reset means includes a manually operable initial key.

17. Copying machine as claimed in claim 12 in which said select means includes two manually operable switch means whereby either one of said first to third premaintenance means is selected according to a combination of ON/OFF states of said two switch means.

* * * * *